US009126075B2

(12) United States Patent
Tomaszewski

(10) Patent No.: US 9,126,075 B2
(45) Date of Patent: Sep. 8, 2015

(54) EXERCISE STAFF

(71) Applicant: Philippe Til Tomaszewski, Paris (FR)

(72) Inventor: Philippe Til Tomaszewski, Paris (FR)

( * ) Notice: Subject to any disclaimer, the term of this patent is extended or adjusted under 35 U.S.C. 154(b) by 259 days.

(21) Appl. No.: 13/662,342

(22) Filed: Oct. 26, 2012

(65) Prior Publication Data

US 2013/0296145 A1 Nov. 7, 2013

Related U.S. Application Data

(60) Provisional application No. 61/553,068, filed on Oct. 28, 2011.

(51) Int. Cl.

| | |
|---|---|
| ***A63B 21/072*** | (2006.01) |
| ***A63B 21/075*** | (2006.01) |
| ***A63B 21/02*** | (2006.01) |
| ***A63B 21/045*** | (2006.01) |
| ***A63B 21/06*** | (2006.01) |
| ***A63B 21/00*** | (2006.01) |
| ***A63B 23/12*** | (2006.01) |

(52) U.S. Cl.

CPC ..... *A63B 21/06* (2013.01); *A63B 21/0004* (2013.01); *A63B 21/0724* (2013.01); *A63B 21/1469* (2013.01); *A63B 23/12* (2013.01); *A63B 2210/54* (2013.01)

(58) Field of Classification Search

CPC ..... A63B 21/06; A63B 21/0004; A63B 21/0724; A63B 21/1469; A63B 23/12; A63B 2210/54; A63B 21/00043; A63B 2210/58; A63B 21/02; A63B 21/023; A63B 21/025; A63B 21/026; A63B 21/04; A63B 21/0407; A63B 21/0428; A63B 21/0442; A63B 21/045; A63B 21/0455; A63B 21/05; A63B 21/055; A63B 21/0552; A63B 21/0557; B25G 3/16

USPC ..... 482/106, 121–130, 908

See application file for complete search history.

(56) References Cited

U.S. PATENT DOCUMENTS

| | | | | |
|---|---|---|---|---|
| 3,343,837 | A * | 9/1967 | Grzybowski | 482/126 |
| 4,556,217 | A * | 12/1985 | Kochan | 482/128 |
| 4,913,417 | A * | 4/1990 | Francu | 482/45 |
| 6,196,921 | B1 * | 3/2001 | Larson | 463/47.2 |
| 6,402,668 | B1 * | 6/2002 | Harker | 482/121 |
| 8,505,129 | B2 * | 8/2013 | Parker et al. | 4/610 |
| 2008/0081747 | A1 * | 4/2008 | Mok | 482/121 |
| 2009/0093349 | A1 * | 4/2009 | Cooper | 482/106 |

* cited by examiner

*Primary Examiner* — Oren Ginsberg
*Assistant Examiner* — Joshua Lee
(74) *Attorney, Agent, or Firm* — Kleinberg & Lerner, LLP; Marvin H. Kleinberg; Marshall A. Lerner

(57) ABSTRACT

An exercise staff is comprised of two half staffs which can be coupled together. Each half staff includes a handle portion and a base portion, connected by a spring. An inner cylinder connected to the handle portion has an L-shaped groove with an axial segment. A pin in the base portion engages the groove and when the pin is in the axial portion of the groove, the handle and base portions may be separated with resistance by the spring. The handle portion is adapted to receive inserts of varying weights to modify the mass of the staff in use.

8 Claims, 5 Drawing Sheets

EXERCISE STAFF

BACKGROUND OF THE INVENTION

1. Field of the Invention

The present invention relates to portable fitness equipment, such as weighted or non-weighted bars, martial arts fighting sticks, elastic tubing, Indian clubs, a simple broom stick or dowel, as well as weights that can be housed inside the handle, or dumbbells.

2. General Background and State of the Art

In the field of personal training, when there is a requirement for the fitness trainers to travel and provide services to their clients and the clients to not own or have access to certain pieces of equipment, the trainer has to bring the equipment along. In many cases, in order to address the needs of each individual client, more than one device or tool is required and carrying all the equipment at once can be cumbersome and inconvenient. What is needed, and what is not presently available, is a versatile, yet highly portable exercise device that will enable training in diverse disciplines.

INVENTION SUMMARY

The present invention offers the portability, versatility and ability to deliver several training modalities and approaches at once, through a convenient, lightweight and unique design. Various degrees of resistance are provided through the use of tension springs as well as weight loading options. Leverage can be varied by using the invention in its full length with the two connected staves forming one, or by using only one or both unit staves in their non-connected form, depending on the needs, skills and abilities of the user.

Each unit staff is hollow and is comprised of two telescoping members, joined by a tensioning member which, in a preferred embodiment, can be a coil spring. One of the members has an internal pin which rides in a groove of the other member so that a slight rotation of the members relative to each other permits axial motion of the members against the tension spring. Normally, the members are locked together.

At one end of each unit staff is an end cap which, when removed, permits the insertion of weight elements of various values, preferably in half pound increments so that a weight of any selected value can be added to the unit staff. In the preferred embodiments, the weight elements are metal cylinders of uniform length sized to occupy an interior volume of the unit staff. It may be desirable to allow the weight element to oscillate within the unit staff and the weight element would be sized accordingly.

At the other end of each unit staff is a coupling member which allows two unit staff members to be conjoined to create a longer exercise staff that can be used in outstretched arms to accommodate a greater variety of exercise and martial art activities. Such a full length staff could also be fitted with a pin or foot for use as a walking or hiking staff.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 2 including

FIG. 3, including

DETAILED DESCRIPTION OF THE PREFERRED EMBODIMENTS

Figure 1:
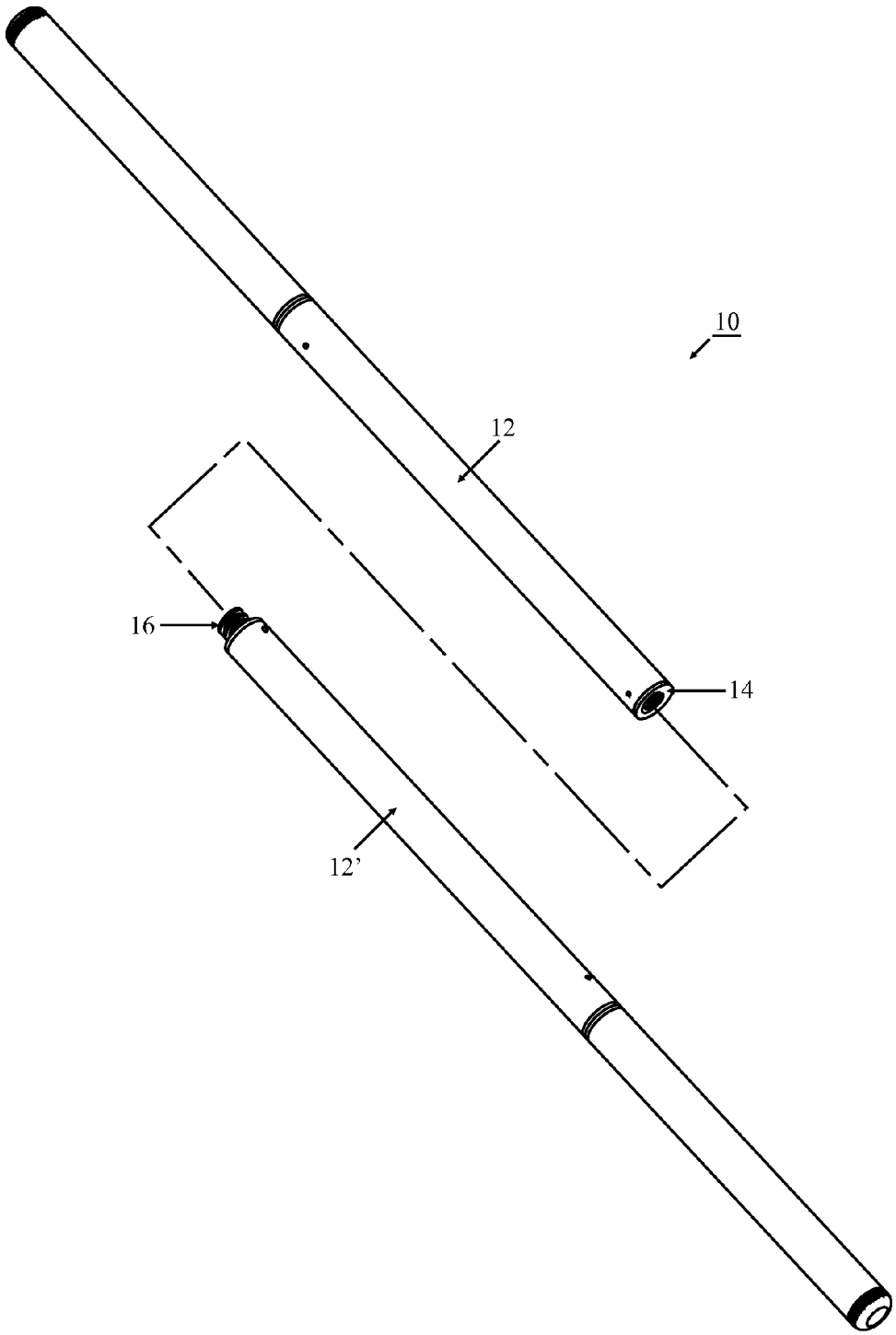
FIG. 1 is a perspective view of an exercise staff separated into component half staffs according to the present invention.

Turning first to FIG. 1, there is shown an exercise staff 10 according to the present invention. As shown, the staff 10 is composed of two half staff elements 12, 12'. A female threaded end cap 14 at the end of one staff 12 receives the male threaded end cap 16 of the other half staff 12' to form a completed staff 10.

Figure 2A:
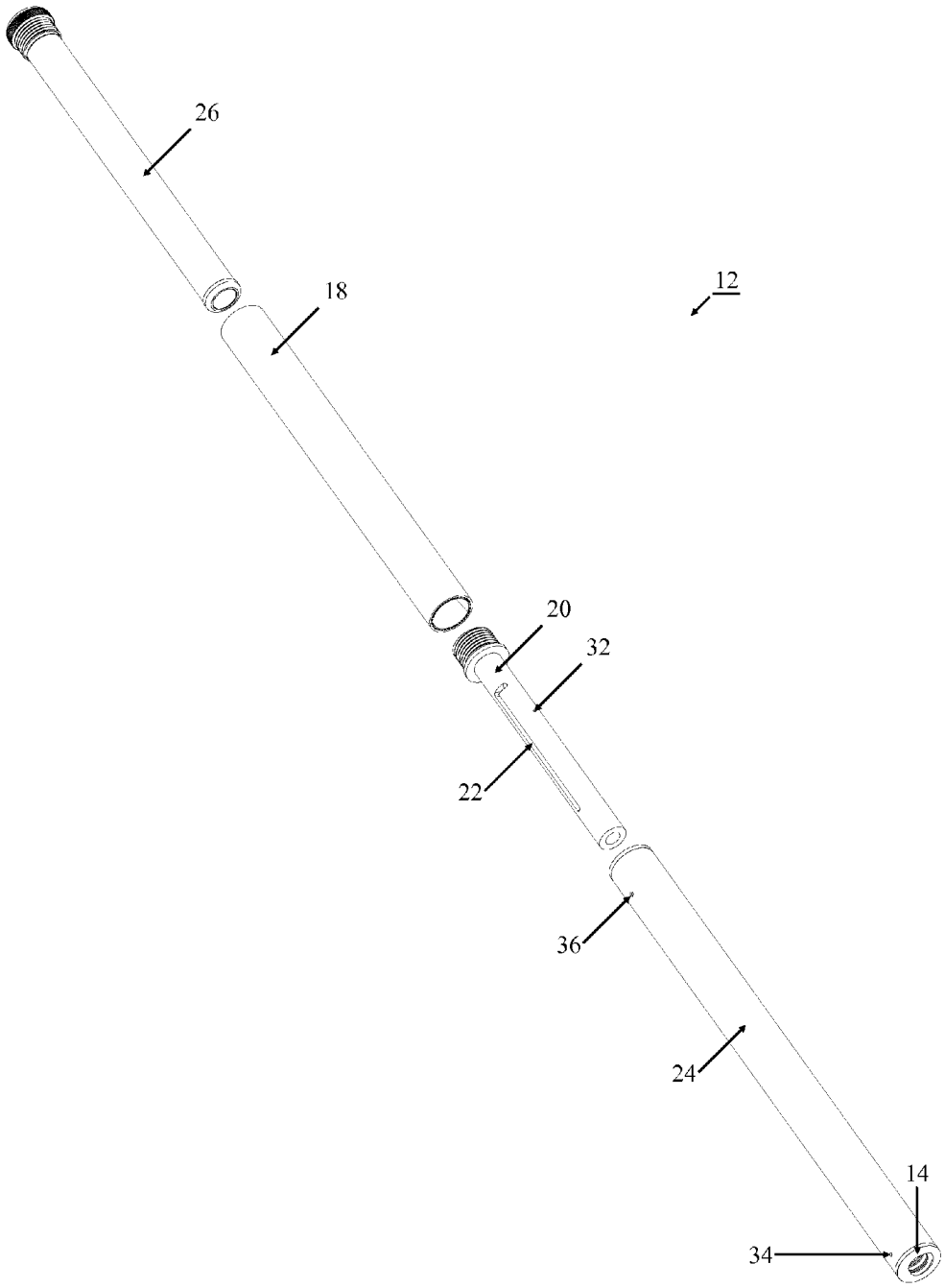
FIGS. 2A and 2B is an exploded and cutaway view of the constituent parts of a half staff element.

FIG. 2A is an exploded view of half staff 12 although both halves are symmetrical and, except for the end caps, are interchangeable. A handle tube 18 has a guide tube 20 which includes, on the exterior an L-shaped tracking groove 22. The guide tube 20 attaches to the inner end of the handle tube 18 and is adapted to telescope into an intermediate tube 24 which has, at the inner end, the female threaded end cap 14.

An optional ballast tube 26 can telescope into the outer end of the handle tube 18. In preferred embodiments, the ballast tube 26 can add additional weight to the half staff 12 in amounts ranging from ½ pound 5 pounds to in one-half pound increments. With weights in both half staffs 12, 12', the weight of the exercise staff can be increased from one pound to ten pounds in the preferred embodiments. In alternative embodiments, greater weights could be added by utilizing different materials for the ballast.

Figure 2B:
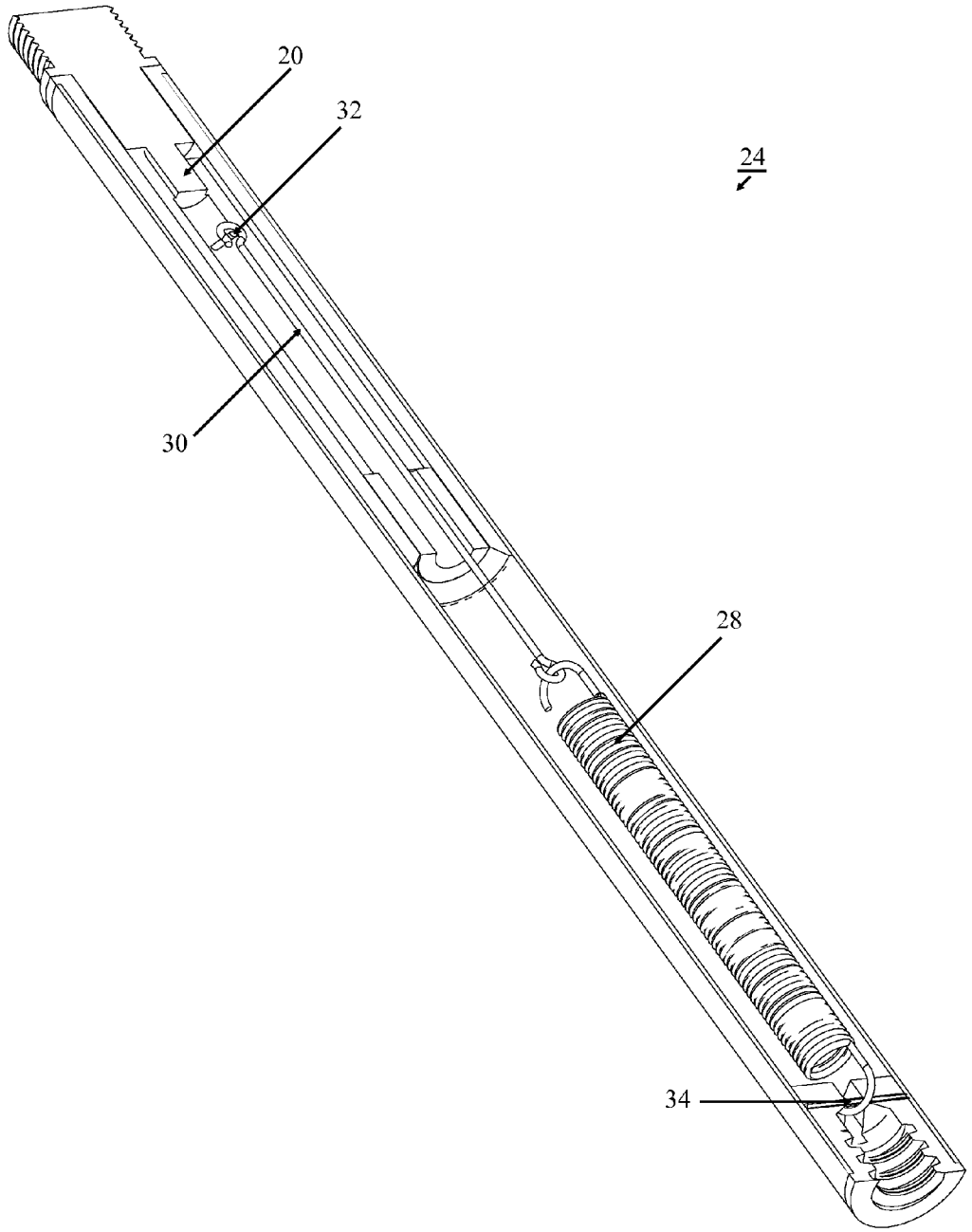

FIG. 2B is a cutaway view of a portion of the intermediate tube 24, showing a portion of the inserted guide tube 20. A tensioning spring 28 is mounted in the interior of the intermediate tube 24 and, through a tension link 30, is connected to the guide tube 20. While a spring is used in the preferred embodiment, other tensioning materials can be utilized including neoprene, rubber or other elastomers. A handle pin 32 can anchor the tension link 30 to the guide tube 20 and the tensioning spring 28 can be anchored to the intermediate tube 24 with an anchor pin 34 that captures either one end of the tensioning spring 28 or an intermediate link (not shown) which connects to the opposite end of the tensioning spring 28.

A tracking pin 36 in the intermediate tube 24 engages the tracking groove 22 of the guide tube 20. When the parts are fully assembled, the tracking pin 36 in the L portion of the tracking groove 22 permits limited rotation of the tubes relative to each other about the central axis. The tensioning spring 28 provides sufficient rotational bias so that the tracking pin 36 remains in the circumferentially oriented portion of the tracking groove 22. Rotation of the handle tube 18 relative to the intermediate tube 24 is only permitted in one direction by the tracking groove 22.

When the tracking pin 36 reaches the axially oriented portion of the tracking groove 22, the handle tube 18 and the intermediate tube 24 are free for translational motion in the axial direction against the resistance of the tensioning spring 28. When the handle tube 18 and the intermediate tube 24 are fully collapsed together, they will rotate relative to each other and the tracking pin 36 will again be in the circumferential portion of the tracking groove 22. FIG. 2C shows the half staff 12 in that normal, resting state.

Figure 3A:
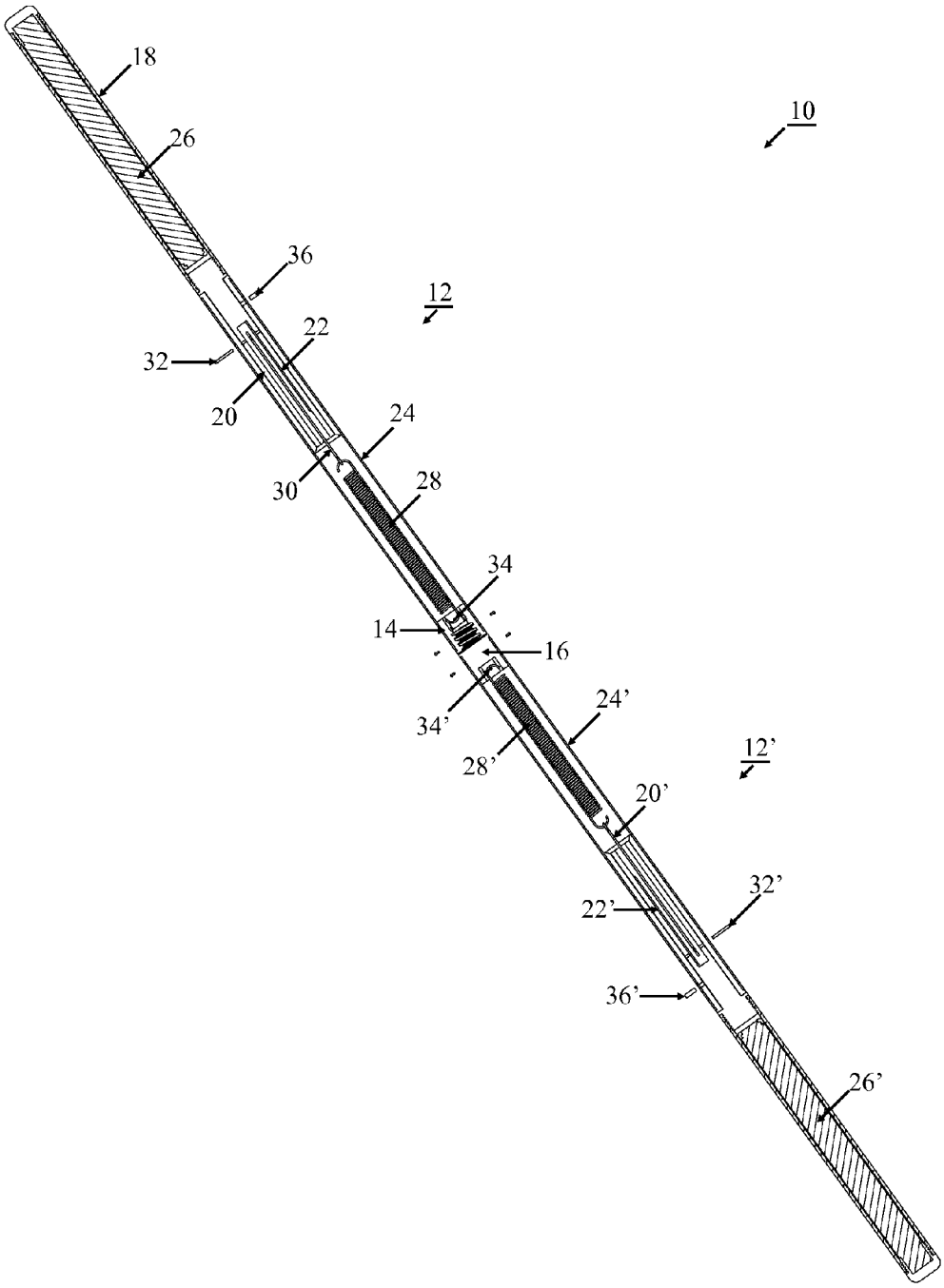
FIGS. 3A and 3B is a cut away top view of a staff in a closed configuration and in an opened configuration.
Figure 3B:
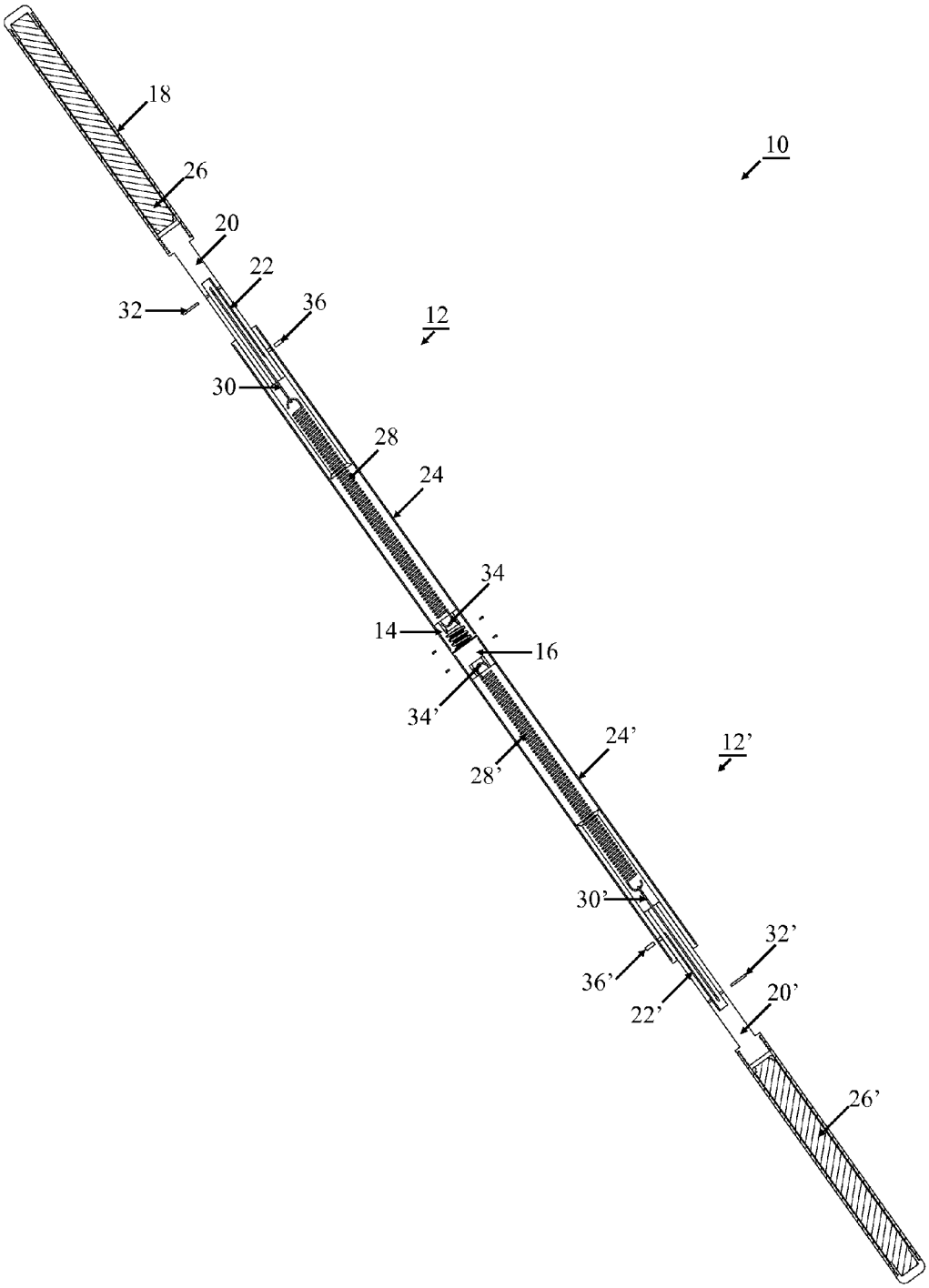

FIG. 3A is a cutaway view of the staff 10 in a closed configuration with the various component parts shown in place. As shown, the parts in half staff 12' use the same reference numbers as their counterparts in the half staff 12 but with the prime symbol. Thus spring 28 of half staff 12 has a counterpart spring 28' in half staff 12'. Similarly in FIG. 3B, the staff 10 is shown in the expanded configuration.

The present invention solves the problems of poor joint mobility, poor flexibility, coordination and tightness, notably at the shoulder (glenuhumeral), hips, lumbar and thoracic spine levels. Additionally, it solves the problem of assessing one's poor posture issues without having to necessarily see a health care practitioner (although not a diagnostic tool), which is still advised for diagnosis and treatment.

Using invention specific progressive simple drills, the user improves glenohumeral joint mobility (shoulder), which also recruits other joints in the body, to effectively increase range of motion, flexibility, muscle tone as well as identify, correct and assess muscular imbalances. It also provides an easy way to correctly warm up and prepare muscles and joints for any workout, or simply relieve stiffness in the joints.

The extendable staff can be separated into halves and used as 2 pieces as well as one solid longer piece. For less flexible users, the extension affords the ability to perform the movements. Shoulder tightness is connected to hip tightness, which is linked to low back pain, which then diminishes overall movement ability, something from which the majority of the population suffers and doesn't treat effectively.

When the halves are connected to form the full length (4 ft.) staff, movements can be performed with it, as qualified personal trainers or therapists may use a dowel or stick. This provides limited uses for those who do not have the proper flexibility or joint mobility. With the quick release at the center of each half staff, the spring loaded mechanism allows the user to stretch the staff to accommodate the user's current ability, until the user can perform the movement without the need for the extension (much like having training wheels on a bicycle). Overhead squats, shoulder brachiation techniques, wrist, elbow, shoulder and hip mobility drills can be performed. On any given day, a person can feel "stiff" (after traveling, sitting at a desk too long, sore from a previous training session or any other limiting factor) and the staff can be adjusted to the user's current condition, effectively improving it within a few movements.

Separated into its component halves, it can be used like Indian clubs, where one can use one arm or both, therefore one or both half staffs can be used for isolateral/unilateral work versus bilateral work. With the ballast (additional weights) weights inserted, one can increase the load to perform resistance training exercises, just as with a bar bell, based on one's ability.

The full staff can also be utilized for various martial arts drills, notably Kali, Eskrima and other martial arts of the type popularized in motion pictures such as Hanna, the Bourne series, The Book of Eli, among others, as well as in staff fighting or stick fighting, The staff of the present invention can also be used for corrective assessment drills (spinal alignment, proper squatting, core stability and more).

The staff has a quick release mechanism that keeps it as a 4 ft unit with the halves connected and may have either a knurled or other textured grip so it can be quickly coupled or separated without having to twist more than a half turn. The same principle is used at the end of the 2 connected half staffs where the extensibility occurs, except that instead of separating, there is a spring that allows each half to extend and return to its original configuration, much as a rubber band would.

As one piece, coil springs inside connect the outer end portions to the to the main/center portion which allows the staff to extend a few inches in each direction providing the user who lacks the necessary flexibility to essentially stretch the staff so that the user can perform a particular exercise requiring motion, be it an overhead squat or a brachiation drill (combining the benefits of a rubber tubing with a broomstick). As the users flexibility improves over time, the halves can be reconfigured to be a rigid full staff to continue the same drills but at greater flexibility and increased difficulty levels.

As one piece the full staff can be used for multiple martial arts drills as well as many corrective drills, such as postural assessments or movement screening (deep squat, overhead extension squat, in line lunge). Also, by inserting ballast weights inside the free end of the half staff (by removing the end cap), the user benefits from added resistance which increases the difficulty level of all drills for better strength development, just as a fitness body bar, essentially used as a bar bell with the weight already inside the bar. With the halves separated, not only does it make it easier to carry for travel but it readily fits into a gym bag, Thus there has been shown and described an novel exercise staff which is suitable for tor physical training, martial arts training or any other suitable activity. Modifications and variations will occur to those skilled in the art and the scope of the invention should be limited only by the scope of the claims appended hereto.

What as claimed as new is:

1. An exercise apparatus comprising:

a. a cylindrical end body portion having a hollow interior;

b. a cylindrical main body portion having a hollow interior;

c. a cylindrical intermediate body portion, having a hollow interior, connected to said end body portion and adapted to be telescopically inserted into said main body portion hollow interior, said intermediate body portion having on its exterior an L-shaped groove with an axial portion and a radial portion and said main body portion having a first pin member extending inwardly and adapted to fit within said groove radial portion whereby rotation of said end and main body portions relative to each other positions said first pin member in said axial portion permitting axial motion of said end and main body portions relative to each other; and d. tensioning means having radial tension resistance and axial tension resistance and connecting said main body portion to said intermediate body portion through said intermediate body portion hollow interior and said main body portion hollow interior whereby said end and main body portions can be axially separated for an overall greater axial length while elongating said tensioning means against said axial tension resistance of said tensioning means, and said end and main body portions can he radially rotated against said radial tension resistance of said tensioning means.

2. An exercise apparatus as in claim 1, further including a second pin member through said intermediate body portion for connecting said tensioning means to said intermediate body portion, whereby said second pin member interacts with said tensioning means, said second pin haying a linear and cylindrical shape.

3. An exercise apparatus as in claim 2, further including a third pin member through said main body portion for connecting said tensioning means to said main body portion, whereby said third pin member interacts with said tensioning means, said third pin member being oriented approximately orthogonally to said second pin member, said third pin member haying a linear and cylindrical shape.

4. An exercise apparatus as in claim 1 further including a second pin member through said main body portion for connecting said tensioning means to said main body portion, whereby said second in member interacts with said tensioning means.

5. An exercise apparatus as in claim 1 wherein said tensioning means rotationally biases said end and main body portions into a locked configuration.

6. An exercise apparatus as in claim 1 wherein said end body portion has a removable threaded end cap and further including weighting means adapted to be inserted into the hollow interior of said end body portion whereby said threaded end cap retains said weighting means within said end body portion.

7. An exercise apparatus as in claim 1 wherein said tensioning means include a spring and a tension link connected to said spring.

8. An exercise apparatus comprising:

a. a first component comprising an exercise apparatus as in claim 1;

b. a second component comprising an exercise apparatus as in claim 1; and c. means axially coupling said first component to said second component to create an exercise staff, said exercise staff being extendable in a linear motion.

* * * * *